US006422561B1

(12) United States Patent
Schroeder

(10) Patent No.: US 6,422,561 B1
(45) Date of Patent: Jul. 23, 2002

(54) WORD SEARCH BASED BOARD GAME WITH DIRECTIONAL TILES

(76) Inventor: Jimmy Dale Schroeder, 20320 Quentin Ave. East, Hastings, MN (US) 55033

( * ) Notice: Subject to any disclaimer, the term of this patent is extended or adjusted under 35 U.S.C. 154(b) by 0 days.

(21) Appl. No.: 09/676,640

(22) Filed: Sep. 30, 2000

Related U.S. Application Data

(60) Provisional application No. 60/157,943, filed on Oct. 6, 1999.

(51) Int. Cl.[7] ..... A63F 3/00
(52) U.S. Cl. ..... 273/272; 273/299
(58) Field of Search ..... 273/243, 272, 273/271, 299, 275

(56) References Cited

U.S. PATENT DOCUMENTS

| | | | | |
|---|---|---|---|---|
| 500,409 | A | | 6/1893 | Monks |
| 1,633,445 | A | * | 6/1927 | Gail et al. |
| 3,779,557 | A | | 12/1973 | Kritzberg et al. |
| 4,244,580 | A | * | 1/1981 | Hoyles |
| 4,252,323 | A | | 2/1981 | Levinrad |
| 4,299,391 | A | * | 11/1981 | Silver |
| 4,306,724 | A | * | 12/1981 | Brezinski |
| 4,331,333 | A | * | 5/1982 | Willcocks |
| 4,341,398 | A | * | 7/1982 | Freyman |
| 4,420,157 | A | | 12/1983 | White et al. |
| 4,448,423 | A | | 5/1984 | Augusta |
| 4,892,319 | A | | 1/1990 | Johnson, II |
| 5,100,150 | A | | 3/1992 | Larman |
| 5,520,394 | A | | 5/1996 | Brueckner |

* cited by examiner

*Primary Examiner*—William M. Pierce
(74) *Attorney, Agent, or Firm*—Geoffrey E. Dobbin

(57) ABSTRACT

A word search based game including a playing surface divided into individual playing cells and a plurality of both alphanumeric playing and directional instruction tiles. The alphanumeric tiles are placed on the playing surface in a manner to form word following a word search format, that is to say words may be forwards or backwards, vertically, horizontally or diagonally and do not necessarily have to form words with every alphanumeric playing tile that happens to be adjacent on the board to the played alphanumeric playing tiles. Directional instruction tiles are of the same size, shape and color as the alphanumeric playing tiles so that they may be drawn at random with alphanumeric playing tiles, but indicate a desired direction in which to form a word and a bonus multiplier if a word follows said direction. Also provided are a plurality of category cards, one drawn at the start of a game, to provide a scoring bonus to words formed which meet the category. The game is adaptable to both a traditional board game format and a computerized format.

16 Claims, 5 Drawing Sheets

| | | | | | | | | | | | |
|---|---|---|---|---|---|---|---|---|---|---|---|
| | | | | | | | | E | | | |
| | | | | | | | S | | | | |
| | | | | | | C | L | | | | |
| | | | | | H | | O | | | | |
| | | | | E | | | O | | | | |
| | | | W | H | E | A | T | | | | |
| | | | | | | | | | | | |
| | | | | | | | | | | | |
| | | | | | | | | | | | |
| | | | | | | | | | | | |
| | | | | | | | | | | | |
| | | | | | | | | | | | |

FIG. 8

| | | | | | | | | | | | |
|---|---|---|---|---|---|---|---|---|---|---|---|
| | | | | | | | | E | | | |
| | | | | | | | S | | | | |
| | | | | | | C | L | | | | |
| | | | | O | H | I | O | | | | |
| | | | | E | | | O | | | | |
| | | | W | H | E | A | T | | | | |
| | | | | | | | | | | | |
| | | | | | | | | | | | |
| | | | | | | | | | | | |
| | | | | | | | | | | | |
| | | | | | | | | | | | |
| | | | | | | | | | | | |

FIG. 9

WORD SEARCH BASED BOARD GAME WITH DIRECTIONAL TILES

This application claims priority from Provisional application Ser. No. 60/157,943, filed Oct. 10, 1999.

FIELD OF INVENTION

The present invention relates to a board game and more specifically relates a word forming board game that is based on a word search premise.

BACKGROUND OF THE INVENTION

Word forming board games are known in the prior art. The most popularly known example is SCRABBLE. In most such games, letter tiles are drawn from a plurality of provided tiles and are placed on a playing board in such a manner as to form words. The placement of the letters must follow a specific set of rules in order to provide the challenge which in turn provides for the entertainment factor of the game in question. The vast majority of these games are crossword based, which is to say that the players are constructing a crossword puzzle on the game board. For example, U.S. Pat. No. 3,779,557 to Kritzberg, et al.; U.S. Pat. No. 4,252,323 to Levinrad; U.S. Pat No. 4,420,157 to White, et al.; U.S. Pat No. 4,448,423 to Augusta; U.S. Pat No. 4,892,319 to Johnson, II; U.S. Pat No. 5,100,150 to Larman; U.S. Pat No. 5,520,394 to Brueckner and WORDSEARCH by Waddingtons Games Ltd. are all illustrative of the prior art.

Kritzberg Nathan I., et al.

Psychological Testing and Therapeutic Board Game Apparatus

U.S. Pat. No. 3,779,557

A game that includes a stimulus board having a number of emotionally significant words arranged thereon. Lettered playing pieces are employed to permit players to complete words on the board and thus receive an intermediate reward. The word completed is used as a jumping off point for storytelling, answering questions about the story told and dramatizing the story told. All of these additional steps in the game provide additional intermediate rewards. White squares and white pieces permit undirected storytelling. Gold squares and gold pieces require the selection of one of a series of cards that provide a very directed type of storytelling. Intermediate rewards during the game and more concrete rewards at the end of the game enhance the game feature and provide an incentive for storytelling and fantasizing.

Levinrad, Maxim D.

Board Game with Color Tiles and Letter Tiles

U.S. Pat. No. 4,252,323

A game in the course of which words are formed by juxtaposing letter carrying tiles in a cross word fashion, each word either starting adjacent a colored panel on a board on which the game is played or adjacent a colored tile already placed on the board or crossing a word already on the board and each word having a colored panel behind its terminal letter such that, when the game is over, the board has the appearance of a true cross word puzzle. Scores are achieved according to the length of the words formed and crossed and the positioning of colored tiles in the best available positions. Also included in the invention is apparatus for use in playing the game.

White, Peter H., et al.

Apparatus for Playing a Game

U.S. Pat. No. 4,420,157

Apparatus for playing a game of the kind in which competitors make conjoined words in a crossword format comprises a game area in the form of a large square subdivided by mutually perpendicular sets of parallel lines into 225 smaller adjoining spaces. Also provided for each participant are one reserve area and one play area comprising 42 squares and 10 squares or spaces, respectively. Also provided is an initial allotment to each participant of an equal set of lettered playing pieces and one universal playing piece or "eagle" for disposal in the respective reserve areas. Each playing piece has only one of two different scoring values, that are denoted by its color, and scoring depends upon the total scoring value of the or of each word formed in crossword format on the game area during alternate turns of play. A game played with the apparatus substantially completely eliminates the "luck" component associated with prior crossword format games and relies solely upon the skill of the individual participants.

Augusta, George V.

Board Game

U.S. Pat. No. 4,448,423

Apparatus for playing a competitive board game including a flat playing surface divided into upper and lower sections, a plurality of playing pieces, and randomized selector holders for holding sets of playing pieces during play. The playing pieces include reference indicia on the top surface to indicate alphabetic consonants, vowels, or blanks which may represent consonants or vowels. The playing pieces are provided with further indicia of color to distinguish each players set of playing pieces and further indicia on the bottom surface to distinguish playing pieces with consonants from those having vowels or blanks. The object of the game is to form colorwords by juxtaposing colored letter carrying playing pieces in the upper section. The color words may be extended to form other words. The word is won, when no further letters can be added, by the player whose colored letters outnumber those of any other players. The lower section is used to discard letters in juxtaposition to form words. Playing pieces may be substituted in the lower section to obtain particular letters and/or colored letters for play in the upper section so long as the substitution forms a word.

Johnson, II, Theodore D.

Word Game

U.S. Pat. No. 4,892,319

An apparatus for a word game is disclosed. A game board surface is divided into a number of squares into which playing pieces containing letters of the alphabet are placed to form a word. The various words are contained in groups which, when of a certain size, are considered to be an ISLAND which creates the right to start a new word independent from all others, which is an ATOLL. Except for ATOLLS and the beginning of the game, any new letters added must form a word with those letters already on the playing field. New words which link one ISLAND to another ISLAND or ATOLL are ISTHMUSES and capture the ISLAND OR ATOLL to which they are linked as part of the territory for the player creating such an ISTHMUS. Two iscosahedron dice having their faces numbered from 1 to 20 are used to randomly select numbers from 2 to 40. These numbers are related to the letters of the alphabet by a decoder with the frequency of the number approximating the frequency of the use of letters in making words. The seldom used letters of the alphabet are increased through the use of a number of bonus letters and the value of the individual letters vary based on a scoring code. The individual ownership of ATOLLS, ISTFMUSES, and, ISLANDS is shown by a color coded transparent flag placed on top of one of the previously played letters.

Larman, Daryl S.

Word Forming Board Game with Rotatable Two Level Board and

Chance Device

U.S. Pat. No. 5,100,150

A word game assembly for play by two or more players includes for each player a play grid of horizontal and vertical rows of adjacent areas and a supply of alphabetical letter designating play pieces receivable on the grid areas in a competitive attempt to form words. A player operated random selector and indicator device, such as a spinnable top having side facets marked with different symbols, is used to determine the nature and procedure of play for effecting a series of plays. For instance, each player may select play pieces and place them on an associated play grid to form words in dependence upon the indicated random selection resulting from the spin of the top. In one embodiment of the word game assembly, a portion of the play grid is rotatable.

Brueckner, James L.

Word Forming Board Game

U.S. Pat. No. 5,520,394

A game for forming words upon a board to entertain and educate players. The inventive device and method includes a board for stimulating various crossword puzzle configurations upon which a plurality of tiles can be positioned to form words. The method of playing includes forming original and altered words upon the board. Score is kept during the game with the player having the highest score or the player covering the last one of a predetermined number and configuration of spaces on the board being declared the winner.

Unpatented Prior Art

Wordsearch: The Game of Finding Words

Waddingtons Games, Ltd., 1988

WORDSEARCH discloses a word search based board game where words may be formed in any direction. Letter tiles are both played onto the playing surface and moved around on the playing surface in order to accomplish word formation.

While the aforementioned inventions accomplish their individual objectives, they do not describe a word search based board game utilizing bonus directional tiles. In this respect, the game according to the present invention departs substantially from the usual designs in the prior art. In doing so, this invention provides a word search based board game that uses directional instruction tiles to add to the chance and challenge aspects of the game.

SUMMARY OF THE INVENTION

In view of the foregoing disadvantages inherent in the known types of word games, this invention provides an improved word game. As such, the present invention's general purpose is to provide a new and improved word search game that uses directional instruction tiles to guide game play.

Players receive a plurality of tiles from a central depository and organize them in the most advantageous manner to form words on a playing surface. The playing surface should incorporate a means of fixing the tiles to the surface, as the importance of tile position increases as the board is filled. The first player positions a word, preferably near the center of the board and later players have only the restrictions that they must use at least one letter in play on the board and words must be formed in a straight line. Otherwise, words may be formed in any direction, as is customary in word search puzzles. Played tiles do not need to form any words with any other adjacent tile, other than tiles positioned on that player's turn. Score may be determined by adding the number of tiles and multiplying by a set score amount or by adding the value of individual letter tiles played. Play continues until no other tiles may be played and the player with the highest score is then declared the winner. Also included in the game is a set of directional instruction tiles which may be drawn from the depository whenever a player replenishes his tile bank. These tiles include an indicated direction (e.g., diagonal and backwards) and an indicated multiplier if a played word follows said indicated direction. Other variations of the game include a category card that may be drawn at random at the start of the game to provide a constant bonus multiplier for any played words that fulfill the category designation. Another variation is a head-to-head version where players compete to form words from the same set of drawn letter tiles. This second variation is better suited to use on a computer.

The more important features of the invention have thus been outlined in order that the more detailed description that follows may be better understood and in order that the present contribution to the art may better be appreciated. Additional features of the invention will be described hereinafter and will form the subject matter of the claims that follow.

The primary object of the present invention is to provide a word search based game that is entertaining to play.

It is another object of the invention to provide a word search based game that is adaptable to either a conventional board game or computer format.

It is still another object of the invention to provide a word search based game that uses directional instruction tiles to add to the random and entertainment values of the game.

It is a further object of the invention to provide a word search based game that is adaptable to numerous variations of play.

It is an even further object of the invention to provide a word search based game that is economical to manufacture and produce so as to keep eventual costs to the consumer reasonable.

Other objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

FIGS. 6–9 are the first four turns of a sample game.

DETAILED DESCRIPTION OF THE PREFERRED EMBODIMENT

Figure 1:
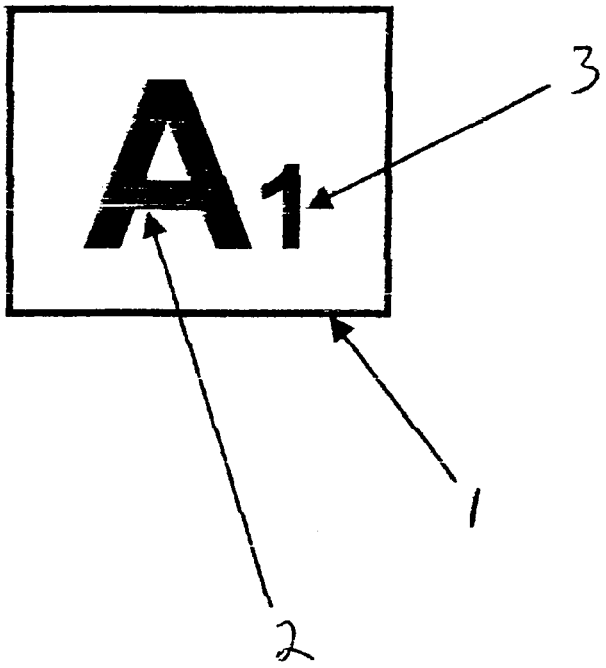
FIG. 1 is a top plan view of an alphanumeric playing tile.
Figure 2:
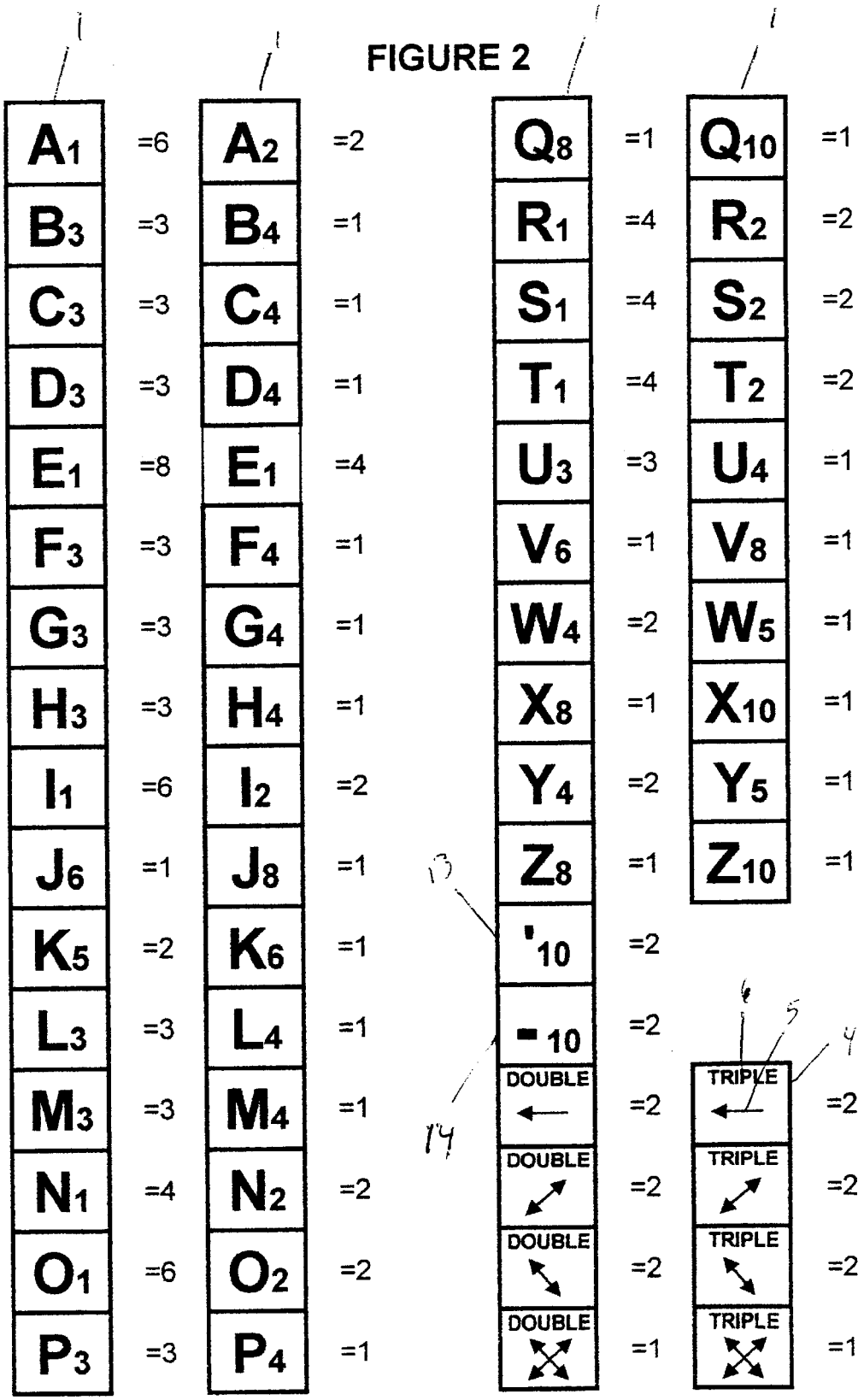
FIG. 2 is a plan view of all tiles, showing a relative population of all tiles in the depository at the start of the game.

With reference now to the drawings, the preferred embodiment of the word search based board game is now described herein. Referring to FIG. 1, alphanumeric playing tiles 1 are used to form words on a playing surface 30, shown in FIG. 3. Referring again to FIG. 1, tile 1 is demarcated with two symbols, an alphabetic character 2 and a scoring value 3. Players start the game by drawing seven such tiles from a central depository. Included in the tiles, as shown in FIG. 2, are a plurality of directional instruction tiles 4. Each such tile has a direction arrow 5 and scoring instruction 6. Players receive the product of their original score multiplied by the scoring instruction 6 if and when a played word follows the direction arrow 5 of a simultaneously played directional instruction tile 4.

Figure 3:
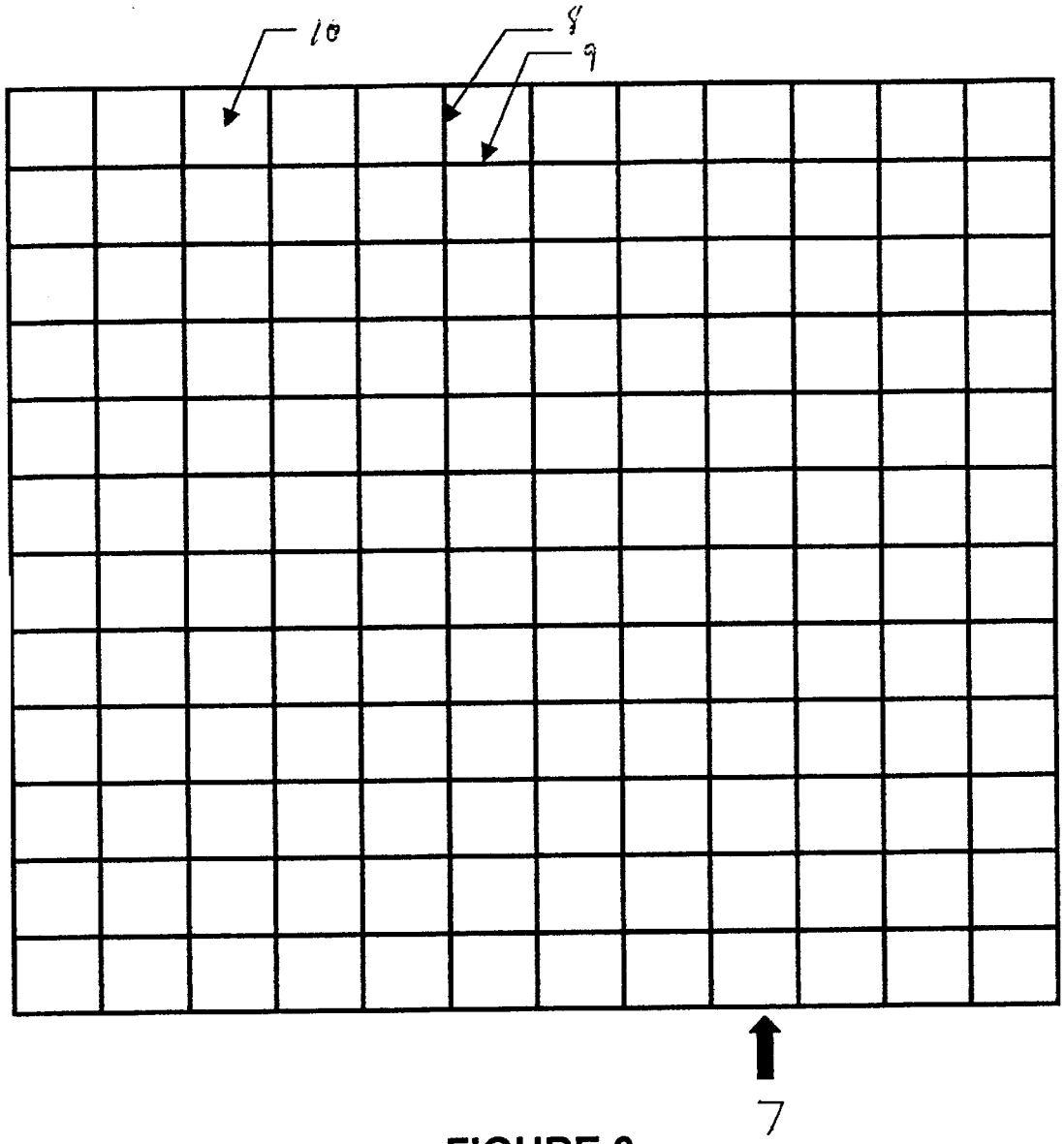
FIG. 3 is a top plan view of the playing surface.
Figure 4:
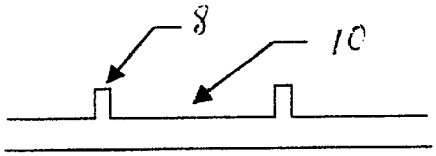
FIG. 4 is a side plan view of the playing surface detailing the board structure.

The first player organizes his tiles 1 into a word and places said letter tiles 1 on the playing surface 7 to form a word. The surface 7, shown in FIG. 3, is divided by a plurality of vertical 8 and horizontal 9 lines. These lines, therefore, form playing cells 10 suitably sized to reserve a space on the playing surface 7 in which an individual tile 1 must be placed when played. Ideally, the lines 8 and 9 are raised with respect to the playing surface 7 shown in FIG. 4. By raising the lines 8 and 9, the tiles 1 are fixed in their position relative to other tiles on the surface 7.

After the first player positions his first word, other players follow suit by playing other tiles to form more words. All new words must use at least one letter tile already in play on the playing surface 7. Words may be played in any direction, either forwards or backwards, in a straight line. Only the tiles being played and the previously played tile need to form a word. Other adjacent tiles are irrelevant, though, in another variation of the game, any collateral words formed from adjacent tiles may be added to a player's score. Scoring is achieved by adding the scoring values 3 on all tiles used to form new words. If a player desires to use a direction instruction tile 4, it is played to the side of the board 7, showing other players that the player is playing it and removing it from future play. Play continues until no other tiles may be played or players run out of tiles. The player with the highest score wins. Penalties, such as adding the values of any remaining tiles in a player's possession and subtracting the amount from that player's score, may be levied, with a set value, such as 10 points for double tiles and 15 points for triple tiles, levied for any directional tiles in a player's possession at the end of the game.

Words should be able to be found in a standard dictionary and abbreviations and contractions normally are not allowed. Only one directional instruction tile may be played in any one turn. Players replenish their supply of tiles after their respective turns and may opt to pass by exchanging any number of tiles in his possession with other tiles in the central depository. A bonus of, for example, 25 points may be given if a player uses all seven of his tiles on one turn, including directional instruction tiles.

Figure 6:
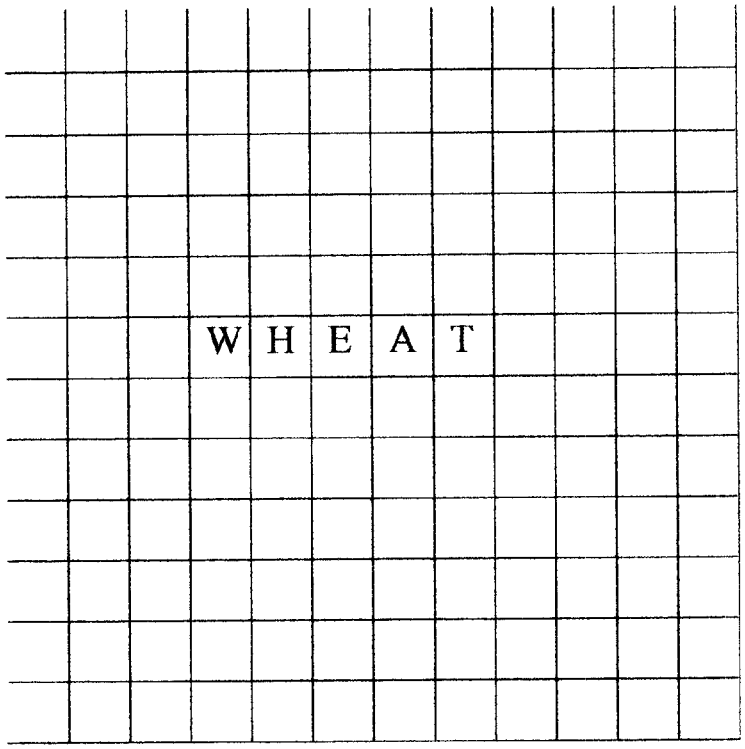
Figure 7:
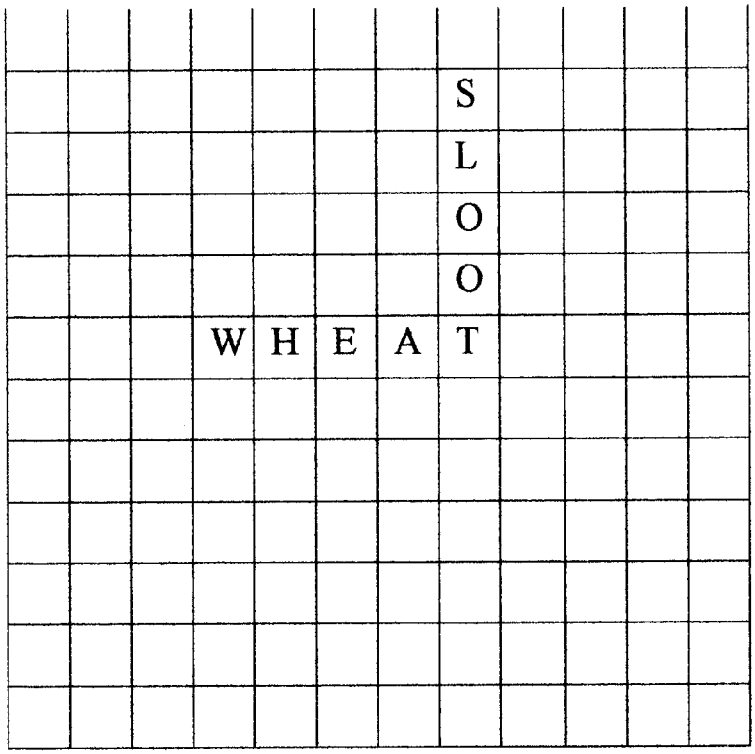

The first four moves of a sample game are shown in FIGS. 6, 7, 8, and 9. In FIG. 6, the first player places the word "wheat" on the playing surface. In FIG. 7, the second player then places the word "tools" using the "t" in "wheat". The word "tools" extends vertically upwards. The third player then places the word "eschew" in FIG. 8, using the "s" in tools and "w" in "wheat" to complete the word. The word "eschew" extends diagonally downwards and is read backwards. In FIG. 9, the fourth player places the word "Ohio" using the "h" in "eschew" and the second "o" in "tools". This word would be legal in the category variation described below. As can be seen, neither the first "o" nor the "i" form words with any other adjacent tile, other than those used to form the word "Ohio".

Figure 5:
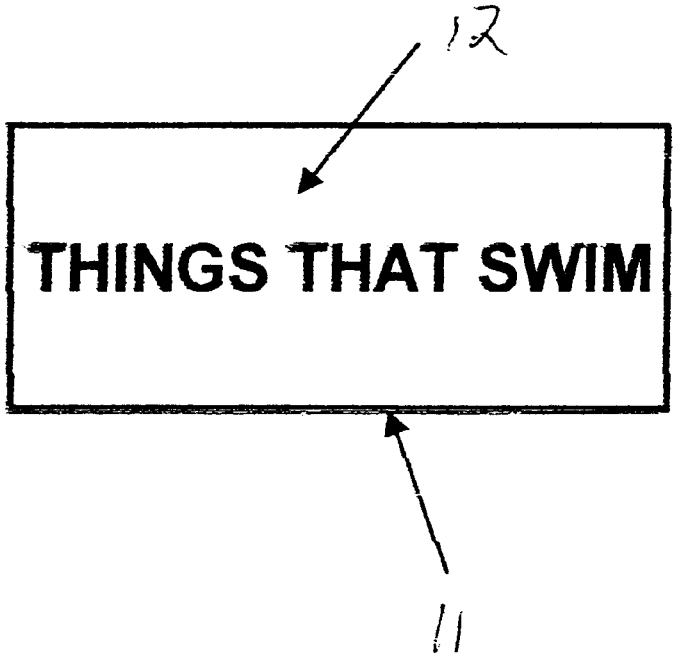
FIG. 5 is a top plan view of a category card.

Another variation includes the use of category cards 11, shown in FIG. 5. Category cards 11 are drawn at the beginning of the game and provide bonus multipliers, such as score times 2, for played words that match the category 12 shown on a drawn card. In this variation, two words commonly used together, such as "blue jeans," may also be used to fulfill a category requirement by simply eliminating the space between the words. In the event a directional instruction tile is played and the word fits a category, both instructions are followed and the player's score is multiplied by the category and directional multipliers.

In another variation, hyphenated words and contractions may be allowed by utilizing the apostrophe 13 and hyphen 14 tiles shown in FIG. 2. In yet another variation, collateral words, extra words formed by using played tiles and adjacent tiles other than tiles used to form the primary word, may be scored by a player. If a player forms a collateral word and does not notice, the next player, and the next player only, may indicate the collateral word and add the point value of the collateral word to his score.

In still another variation, one more suited to play on a computer, the computer generates a bank of seven letters and players have a set amount of time to press an indicator key and lock other players out. Once pressed, the player positions letters on the screen board to form a word and thereby receives points. After the player is finished, the computer generates a new bank of letters. Otherwise, play continues normally. This could be adapted to non-computerized use on a standard board with some form of mechanical indicator device. In all variations, the playing surface 30 is preferred to be a 12×12 grid, though this size may be increased or decreased to alter difficulty.

Although the present invention has been described with reference to preferred embodiments, numerous modifications and variations can be made and still the result will come within the scope of the invention. No limitation with respect to the specific embodiments disclosed herein is intended or should be inferred.

I claim:

1. A word search based board game, the method of playing which comprises the steps of:

players drawing a plurality of playing tiles from a provided bank of both alphanumeric and directional tiles, said alphanumeric tiles indicating a letter and score value and said directional tiles indicating a bonus direction;

players in turn placing combinations of playing tiles on a provided playing surface so as to form words in any direction and also to earn a bonus entitlement for any words formed on the playing surface during an individual player's turn, the direction of said words following the bonus direction indicated on any directional tiles revealed by that player during that turn; and scoring words played by adding the score values imprinted on alphanumeric tiles forming the words in order to obtain initial scores for each word, multipling the initial score of any word by any bonus entitlement for that word so as to obtain a new bonus score, said bonus score replacing the entitled word's initial score, and adding the initial and bonus scores for each word together to obtain a final score;

wherein the playing surface is divided into playing cells by a plurality of vertical and horizontal lines, said cells demarcating a position to place a playing tile and the alphanumeric and directional playing tiles are of identical size and color so that they are otherwise indistinguishable from each other.

2. The game of claim 1, further comprising a step whereby any new words played after the first played word must share at least one letter tile with at least one other word on the board.

3. The game of claim 2, further comprising a step whereby a card is drawn from a provided plurality of category cards and additional bonus scoring is provided for words that satisfy the drawn category card, wherein each card in the plurality of category cards designates a single category.

4. The game of claim 1, further comprising a step whereby a card is drawn from a provided plurality of category cards and additional bonus scoring is provided for words that satisfy the drawn category card, wherein each card in the plurality of category cards designates a single category.

5. The game of claim 1, further comprising a step whereby players use a common letter bank by attempting to activate a provided indicator device so as to earn a right to play a word using playing tiles within the common letter bank, wherein the player who first activates the device earns the right to play a word from the common letter bank.

6. The game of claim 5, further comprising a step whereby any new words played after the first played word must share at least one letter tile with at least one other word on the board.

7. The game of claim 6, further comprising a step whereby a card is drawn from a provided plurality of category cards and additional bonus scoring is provided for words that satisfy the drawn category card, wherein each card in the plurality of category cards designates a single category.

8. The game of claim 5, further comprising a step whereby a card is drawn from a provided plurality of category cards and additional bonus scoring is provided for words that satisfy the drawn category card, wherein each card in the plurality of category cards each designate a single category.

9. The game of claim 5, further comprising a step whereby players use a common letter bank by attempting to activate a provided indicator device so as to earn a right to play a word using playing tiles within the common letter bank, wherein the player who first activates the device earns the right to play a word from the common letter bank.

10. The game of claim 9, further comprising a step whereby all new words played after the first played word must share at least one letter tile with at least one other word on the board.

11. The game of claim 10, further comprising a step whereby a card is drawn from a provided plurality of category cards and additional bonus scoring is provided for words that satisfy the drawn category card, wherein each card in the plurality of category cards designates a single category.

12. The game of claim 9, further comprising a step whereby a card is drawn from a provided plurality of category cards and additional bonus scoring is provided for words that satisfy the drawn category card, wherein each card in the plurality of category cards designates a single category.

13. The game of claim 5, further comprising a step whereby a card is drawn from a provided plurality of category cards and additional bonus scoring is provided for words that satisfy the drawn category card, wherein each card in the plurality of category cards designates a single category.

14. The game of claim 1, wherein the game is played on a computer having a CPU, RAM memory and a CRT and the alphanumeric and directional playing tiles are stored in the computer's RAM memory as a coded array and the playing surface is the computer's CRT.

15. The game of claim 14, further comprising a step whereby any new words played after the first played word must share at least one letter tile with at least one other word on the board.

16. The game of claim 15, further comprising a step whereby a card is drawn from a provided plurality of category cards and additional bonus scoring is provided for words that satisfy the drawn category card, wherein each card in the plurality of category cards designates a single category.

* * * * *